US012564881B2

(12) United States Patent
Shao et al.

(10) Patent No.: US 12,564,881 B2
(45) Date of Patent: Mar. 3, 2026

(54) AMORPHOUS ALLOY REINFORCED CU—BASED COMPOSITE COATING AND COMPOSITE BULK MATERIAL AND PREPARATION METHOD THEREOF

(71) Applicant: Taizhou University, Taizhou (CN)

(72) Inventors: Ling Shao, Taizhou (CN); Liu Zhu, Taizhou (CN); Na Xue, Taizhou (CN); Weiwei Li, Taizhou (CN); Yincheng Wu, Taizhou (CN); Kerui Peng, Taizhou (CN); Mingxiao Luo, Taizhou (CN); Feilong Xu, Taizhou (CN); Yingqi Huang, Taizhou (CN)

( * ) Notice: Subject to any disclaimer, the term of this patent is extended or adjusted under 35 U.S.C. 154(b) by 0 days.

(21) Appl. No.: 18/870,146

(22) PCT Filed: Jul. 3, 2024

(86) PCT No.: PCT/CN2024/103288
§ 371 (c)(1),
(2) Date: Nov. 27, 2024

(87) PCT Pub. No.: WO2025/156565
PCT Pub. Date: Jul. 31, 2025

(65) Prior Publication Data

US 2025/0235926 A1 Jul. 24, 2025

(30) Foreign Application Priority Data

Jan. 23, 2024 (CN) ..... 202410093977.6

(51) Int. Cl.
*C22C 45/00* (2023.01)
*B22F 1/00* (2022.01)
*C23C 24/04* (2006.01)

(52) U.S. Cl.
CPC ..... *B22F 1/09* (2022.01); *C22C 45/008* (2013.01); *C23C 24/04* (2013.01);
(Continued)

(58) Field of Classification Search
CPC ..... C22C 45/001; B22F 1/09
See application file for complete search history.

(56) References Cited

FOREIGN PATENT DOCUMENTS

CN 103866223 A * 6/2014
CN 107354421 A 11/2017

OTHER PUBLICATIONS

Kang et al. The effect of heat treatment on microstructure and tensile properties of cold spray Zr base metal glass/Cu composite. Surface & Coatings Technology. 280. 2015 (Year: 2015).*

(Continued)

*Primary Examiner* — Cachet I Proctor

(57) ABSTRACT

An amorphous alloy reinforced Cu-based composite coating and composite bulk material and a preparation method thereof, comprising an amorphous alloy reinforced Cu-based composite coating and an amorphous alloy reinforced Cu-based composite bulk material, both the amorphous alloy reinforced Cu-based composite coating and the amorphous alloy reinforced Cu-based composite bulk material comprise at least Cu powder and amorphous alloy ($Fe_{54.61}Mo_{16.8}Cr_{25.8}C_{2.44}Si_{0.35}$) powder, a proportion of the Cu powder included in the amorphous alloy reinforced Cu-based composite coating and the amorphous alloy reinforced Cu-based composite bulk material is 55% to 95%, a proportion of the amorphous alloy ($Fe_{54.61}Mo_{16.8}Cr_{25.8}C_{2.44}Si_{0.35}$) powder content in the amorphous alloy reinforced Cu-based composite coating and the amorphous alloy reinforced Cu-based composite bulk material is 5% to 45%. The thickness of the composite coating provided by the invention is 300 μm to 2000 μm, and the thickness of the composite bulk material reaches the centimeter level.

10 Claims, 1 Drawing Sheet

(52) U.S. Cl.
CPC ..... *B22F 2301/10* (2013.01); *B22F 2301/35* (2013.01); *B22F 2304/10* (2013.01); *C22C 2200/02* (2013.01)

(56) References Cited

OTHER PUBLICATIONS

Nayak et al. Fe—based metallic glass coatings by thermal spraying: a focused review on corrosion properties and related degradation mechanisms. International Materials Reviews. vol. 68. No. 4. 2023 (Year: 2023).*
Zhang et al. Review of nano-phase effects in high strength and conductivity copper alloys. Nanotechnology Reviews, vol. 8, No. 1, 2019 (Year: 2019).*

* cited by examiner

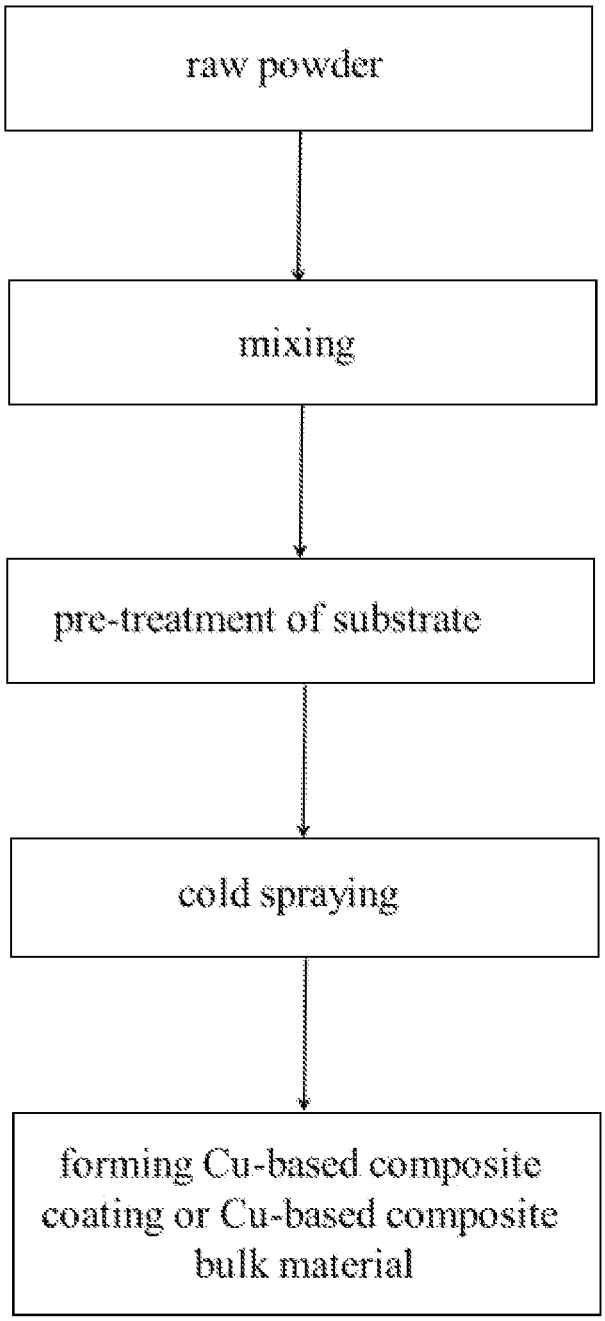
raw powder
mixing
pre-treatment of substrate
cold spraying
forming Cu-based composite coating or Cu-based composite bulk material

AMORPHOUS ALLOY REINFORCED CU—BASED COMPOSITE COATING AND COMPOSITE BULK MATERIAL AND PREPARATION METHOD THEREOF

1. TECHNICAL FIELD

The invention relates to the technical field of metal composite coatings and composite bulk materials, in particular to an amorphous alloy reinforced Cu-based composite coating and composite bulk material and a preparation method thereof.

2. BACKGROUND ART

Cold spray technology involves the generation of supersonic gas flows through heating and pressurizing with low-temperature gas, which accelerates the spray powder to supersonic speeds in the solid state, thereby causing the metal particles to strike the substrate, undergoing intense plastic deformation, and subsequently depositing on the substrate surface to form a coating. The two commonly used cold spray technologies are low-pressure cold spraying and high-pressure cold spraying. However, low-pressure cold spraying, due to its lower spraying pressure, is only suitable for depositing coatings with high plasticity, such as Cu, Al, and Zn. Currently, cold spray technology is widely applied in fields such as additive manufacturing, wear-resistant coatings, and coating corrosion protection.

In prior art, in the fields of coatings and additive manufacturing, people have used cold spraying to prepare pure metal elemental coatings and additively manufactured materials. Among these, pure Cu coatings and additively manufactured materials are widely used, but the resulting materials have drawbacks, such as poor wear resistance; additionally, during the spraying process, there are often gaps or voids between the sprayed particles, which not only affect the performance of the coatings and additively manufactured materials, but also significantly reduce their service life.

After conducting a search, it was found that a Chinese patent discloses a Cu-based composite powder for selective laser melting and forming of Fe-based amorphous reinforced Cu-based alloy (Publication Number: CN112643022A); this invention uses Cu-based composite powder with a particle size of 40 μm to 50 μm as the forming material, and employing the selective laser melting method to prepare the Fe-based amorphous reinforced Cu-based alloy; the Cu-based composite powder mainly consists of Fe-based amorphous powder and Cu alloy powder in a mass ratio of 1:9 to 1:7. The advantages of this invention are as follows: during the selective laser melting process, the Cu-based composite powder undergoes liquid-phase separation and self-assembles to form spherical amorphous Fe particles, which are dispersed within a Cu-rich matrix; the Fe-based amorphous reinforced Cu-based alloy exhibits excellent comprehensive properties such as high strength, high corrosion resistance, high wear resistance, and high thermal conductivity. However, it also has the following defects:

although the Cu-based composite powder of the aforementioned amorphous reinforced Cu-based alloy achieves the excellent comprehensive properties of high strength, high corrosion resistance, high wear resistance, and high thermal conductivity in the Fe-based amorphous reinforced Cu-based alloy, it also has the problem that during the spray coating process, high laser heat in the spray coating method can cause crystallization of the amorphous alloy, thereby causing it to lose the original amorphous characteristics of the amorphous alloy.

After conducting a search, it was found that a Chinese patent discloses an in-situ amorphous particle-reinforced Cu alloy material (Publication No: CN113061778A); this invention belongs to the technical field of the design and preparation technology of Cu alloys and their composite materials, in particular to an in-situ amorphous particle-reinforced Cu alloy material; the material comprises alloy elements Cu and Ni (or Fe, Co), as well as added alloy elements Nb, Ta, Sn, and B (or Si, B, C, Cr, Mo, Co, Ni, and also Nb, Ta, B, Si, C, Nb, Fe, and Mo) that promote the separation of Cu and Ni (or Fe, Co); during rapid cooling of the alloy melt, liquid-phase decomposition occurs first, forming two liquid phases: Cu alloy and Ni alloy (or Fe alloy, Co alloy); the matrix liquid-phase Cu alloy and the second liquid-phase Ni alloy (or Fe alloy, Co alloy) undergo crystalline solidification and amorphous transformation respectively, resulting in the in-situ formation of amorphous particle-reinforced Cu alloy material. In the in-situ amorphous particle-reinforced Cu alloy material of this invention, the reinforcing phase has good interfacial bonding with the metal matrix, the material has high density, and no brittle phases are produced at the interface. However, it also has the following deficiencies:

although the above reinforced Cu alloy material achieves good interfacial bonding with the metal matrix, the material has high density, and no brittle phases are produced at the interface, it also has the following drawbacks of poor wear resistance during the spraying process, and the fact that there are often gaps left between the sprayed particles, which not only affects the performance of the coating and the additively manufactured materials, but also significantly reduces its service life.

3. SUMMARY OF THE INVENTION

The object of the invention is to provide an amorphous alloy reinforced Cu-based composite coating and composite bulk material and a preparation method thereof, which addresses the shortcomings of the prior art in the background technology, particularly in the area of coatings and additive manufacturing, pure metal elemental coatings and additively manufactured materials are prepared through cold spraying, with pure Cu coatings and additively manufactured materials being widely used. However, the materials produced still have drawbacks such as poor wear resistance, and during the spraying process, there are often gaps or voids between the sprayed particles, which not only affect the performance of the coatings and additively manufactured materials, but also significantly reduce their service life. The invention offers the advantages of a simple method, short production cycle, low cost, mild reaction conditions, strong operability, and improved wear resistance of the composite coating and composite bulk material, enhanced tensile strength of the composite bulk material while maintaining the high electrical conductivity of Cu.

In order to solve the above technical problems, the invention provides the following technical scheme:

an amorphous alloy reinforced Cu-based composite coating and composite bulk material, comprising an amorphous alloy reinforced Cu-based composite coating and an amorphous alloy reinforced Cu-based composite bulk material, wherein both the amorphous alloy reinforced Cu-based composite coating and the amorphous alloy reinforced Cu-based composite bulk material comprise at least Cu powder and amorphous alloy ($Fe_{54.61}Mo_{16.8}Cr_{25.8}C_{2.44}Si_{0.35}$) powder.

Preferably, a proportion of the Cu powder included in the amorphous alloy reinforced Cu-based composite coating and the amorphous alloy reinforced Cu-based composite bulk material is 55% to 95%.

Preferably, a proportion of the amorphous alloy ($Fe_{54.61}Mo_{16.8}Cr_{25.8}C_{2.44}Si_{0.35}$) powder content in the amorphous alloy reinforced Cu-based composite coating and the amorphous alloy reinforced Cu-based composite bulk material is 5% to 45%.

Preferably, the particle sizes of both the Cu powder and the amorphous alloy ($Fe_{54.61}Mo_{16.8}Cr_{25.8}C_{2.44}Si_{0.35}$) powder included in the amorphous alloy reinforced Cu-based composite coating and the amorphous alloy reinforced Cu-based composite bulk material range from 20 μm to 50 μm.

A preparation method of the amorphous alloy reinforced Cu-based composite coating and composite bulk material, comprising the following steps:

S1: firstly, sieving the Cu powder particles and the amorphous alloy ($Fe_{54.61}Mo_{16.8}Cr_{25.8}C_{2.44}Si_{0.35}$) powder particles to a specified particle size;

S2: secondly, according to a specified proportion for the composite coating, blending the Cu powder and the amorphous alloy ($Fe_{54.61}Mo_{16.8}Cr_{25.8}C_{2.44}Si_{0.35}$) powder in the above specified proportion;

S3: then, pouring the blended Cu powder and the amorphous alloy ($Fe_{54.61}Mo_{16.8}Cr_{25.8}C_{2.44}Si_{0.35}$) powder into a powder mixer;

S4: once the Cu powder and the amorphous alloy ($Fe_{54.61}Mo_{16.8}Cr_{25.8}C_{2.44}Si_{0.35}$) powder are fully mixed, drying mixed powder;

S5: finally, obtaining the processed amorphous alloy reinforced Cu-based composite coating and composite bulk material.

Preferably, in S3, the powder mixer used is a V-type powder mixer, and the powder mixer used can also be a three-dimensional powder mixer or a two-dimensional powder mixer, and the mixing speed of the powder mixer is 150 r/min to 300 r/min, and the mixing time of the powder mixer is 30 min to 90 min.

Preferably, in S4, the drying time for the mixed Cu powder and the amorphous alloy ($Fe_{54.61}Mo_{16.8}Cr_{25.8}C_{2.44}Si_{0.35}$) powder is 2 h to 6 h, and drying temperature is preferably 40° C. to 80° C.

Preferably, in S4, the Cu powder and the amorphous alloy powder are treated to obtain the mixed powder, and the mixed powder is fed into a powder feeding system of a cold spray system for spraying.

Preferably, the powder feed system comprises at least a receiving device, the receiving device is made of Al alloy substrate, the spraying distance for the spraying process is preferably 20 mm to 40 mm;

the gas used in the spraying process of the cold spray system is at least one of $N_2$, Ar, or He, the preferred gas temperature for the spraying is 500° C. to 800° C., and the preferred gas pressure for the spraying is 3 MPa to 6 MPa.

Preferably, the receiving device needs to be pretreated before use, the pretreatment at least includes sandblasting, ultrasonic cleaning, and drying treatments;

the inlet pressure for the sandblasting treatment is 0.6 MPa to 0.8 MPa, the preferred pressure for the sandblasting process is 0.2 MPa to 0.4 MPa;

the solvent used for ultrasonic cleaning is either ethanol or acetone, the frequency for ultrasonic cleaning is 40 kHz to 80 kHz, and the cleaning time is 10 min to 60 min;

the preferred drying equipment is a compressed air dryer, the drying temperature is preferably 40° C. to 80° C., and the drying time is preferably 2 h to 6 h.

Compared with the prior art, the invention has the following advantageous effects:

1. the spraying process used is cold spraying, which differs from traditional thermal spraying primarily in the extent to which the particles are heated, leading to a different state of the particles before they impact the workpiece surface. In thermal spray process, the powder is usually heated to a molten or semi-molten state; however, in cold spray process, in order to achieve the effect of accelerating the particles, the accelerating gas is sometimes preheated, but the temperature is generally low, allowing the powder particles to remain solid; compared with thermal spray technology, cold spray technology has the advantages of higher spraying rate and deposition efficiency, as well as a coating microstructure that remains consistent with the original material, which can help avoid oxidation or phase transformation of the material; as a result, the thermal impact on the substrate is minimal, while the residual stress in the coating is compressive stress; cold spraying is suitable for preparing bulk materials with specific shapes and sizes, and the coating exhibits high bonding strength and low porosity; additionally, it is environmentally friendly and does not cause pollution, making it a green spray technology.
2. At the spraying temperature of the invention, the amorphous alloy powder of the composite coating and the composite bulk material will produce viscosity during the spraying process, and will deform arbitrarily when attached to the surface of the base, which can completely cover the gaps between the materials, making the material molding more complete, and the $Fe_{54.61}Mo_{16.8}Cr_{25.8}C_{2.44}Si_{0.35}$ Fe-based amorphous alloy has the advantage of low cost.
3. The preparation method provided by the invention is simple, with a short production cycle, low cost, mild reaction conditions, strong operability, and is suitable for large-scale production, and can reduce equipment investment and lower the risks in production.
4. The thickness of the composite coating provided by the invention is 300 μm to 2000 μm, and the thickness of the composite bulk material reaches the centimeter level; this material can enhance the wear resistance of the composite coating and composite bulk material, the tensile strength of the composite bulk material while maintaining the high electrical conductivity of Cu.

4. BRIEF DESCRIPTION OF ACCOMPANY DRAWINGS

FIG. 1 is a specific flow chart of the amorphous alloy reinforced Cu-based composite coating and composite bulk material and the preparation method thereof of the invention.

5. SPECIFIC EMBODIMENT OF THE INVENTION

The technical schemes in the embodiments of the invention will be clearly and completely described in combination with the accompanying drawings in the embodiments of the invention. Obviously, the described embodiments are only some of the embodiments of the invention, but not all of the embodiments. Based on the embodiments in this invention, all other embodiments obtained by those of ordinary skill in the art without making creative efforts shall fall within the protection scope of this invention.

Embodiment 1

Please refer to FIG. 1, an amorphous alloy reinforced Cu-based composite coating and composite bulk material and a preparation method thereof, comprising an amorphous alloy reinforced Cu-based composite coating and an amorphous alloy reinforced Cu-based composite bulk material, wherein both the amorphous alloy reinforced Cu-based composite coating and the amorphous alloy reinforced Cu-based composite bulk material comprise at least Cu powder and amorphous alloy ($Fe_{54.61}Mo_{16.8}Cr_{25.8}C_{2.44}Si_{0.35}$) powder.

A proportion of the Cu powder included in the amorphous alloy reinforced Cu-based composite coating and the amorphous alloy reinforced Cu-based composite bulk material is 55% to 95%.

A proportion of the amorphous alloy ($Fe_{54.61}Mo_{16.8}Cr_{25.8}C_{2.44}Si_{0.35}$) powder content in the amorphous alloy reinforced Cu-based composite coating and the amorphous alloy reinforced Cu-based composite bulk material is 5% to 45%.

The particle sizes of both the Cu powder and the amorphous alloy ($Fe_{54.61}Mo_{16.8}Cr_{25.8}C_{2.44}Si_{0.35}$) powder included in the amorphous alloy reinforced Cu-based composite coating and the amorphous alloy reinforced Cu-based composite bulk material range from 20 μm to 50 μm, preferably 25 μm to 45 μm, and more preferably 30 μm to 40 μm.

Embodiment 2

Please refer to FIG. 1, a preparation method of the amorphous alloy reinforced Cu-based composite coating and composite bulk material, comprising the following steps:

S1: firstly, sieving the Cu powder particles and the amorphous alloy ($Fe_{54.61}Mo_{16.8}Cr_{25.8}C_{2.44}Si_{0.35}$) powder particles to a specified particle size;

S2: secondly, according to a specified proportion for the composite coating, blending the Cu powder and the amorphous alloy ($Fe_{54.61}Mo_{16.8}Cr_{25.8}C_{2.44}Si_{0.35}$) powder in the above specified proportion;

S3: then, pouring the blended Cu powder and the amorphous alloy ($Fe_{54.61}Mo_{16.8}Cr_{25.8}C_{2.44}Si_{0.35}$) powder into a powder mixer;

S4: once the Cu powder and the amorphous alloy ($Fe_{54.61}Mo_{16.8}Cr_{25.8}C_{2.44}Si_{0.35}$) powder are fully mixed, drying mixed powder;

S5: finally, obtaining the processed amorphous alloy reinforced Cu-based composite coating and composite bulk material.

In S3, the powder mixer used is a V-type powder mixer, and the powder mixer used can also be a three-dimensional powder mixer or a two-dimensional powder mixer, and the mixing speed of the powder mixer is preferably 150 r/min to 300 r/min, more preferably 180 r/min to 270 r/min, and even more preferably 200 r/min to 250 r/min; and the mixing time of the powder mixer is preferably 30 min to 90 min, more preferably 40 min to 80 min, and even more preferably 50 min to 70 min.

In S4, the drying time for the mixed Cu powder and the amorphous alloy ($Fe_{54.61}Mo_{16.8}Cr_{25.8}C_{2.44}Si_{0.35}$) powder is preferably 2 h to 6 h, more 3 h to 5 h, and even more preferably 3.5 h to 4.5 h; and drying temperature is preferably 40° C. to 80° C., more preferably 50° C. to 70° C., and even more preferably 55° C. to 65° C.

In step S4, the Cu powder and the amorphous alloy powder are treated to obtain the mixed powder, and the mixed powder is fed into a powder feed system of a cold spray system for spraying; the travel speed of the spraying is preferably 20 mm/s to 80 mm/s, more preferably 30 mm/s to 70 mm/s, and even more preferably 40 mm/s to 60 mm/s, the thickness of the sprayed composite coating is preferably 300 μm to 2000 μm, and the thickness of the composite bulk material is preferably 0.8 cm to 1.2 cm.

The powder feed system comprises at least a receiving device, the receiving device is made of Al alloy substrate, the spraying distance for the spraying process is preferably 20 mm to 40 mm, more preferably 20 mm to 30 mm, and even more preferably 20 mm to 25 mm;

the gas used in the spraying process of the cold spray system is at least one of $N_2$, Ar, or He, the preferred gas temperature for the spraying is 500° C. to 800° C., and the preferred gas pressure for the spraying is 3 MPa to 6 MPa; the mixed powder collides with the Al alloy substrate under the action of high-pressure gas to cause plastic deformation, and then deposits on the surface of the Al alloy substrate to form a composite coating or composite bulk material.

The receiving device needs to be pretreated before use, the pretreatment at least includes sandblasting, ultrasonic cleaning, and drying treatments;

pre-treating the Al alloy substrate can remove the oxide film on the surface, increasing the adhesion between the Al alloy substrate and the composite coating or composite bulk material, the coating has low porosity and is dense, which helps form the high-quality composite coating and composite bulk material;

the inlet pressure for the sandblasting treatment is preferably 0.6 MPa to 0.8 MPa, more preferably 0.65 MPa to 0.75 MPa, even more preferably 0.68 MPa to 0.72 MPa; the preferred pressure for the sandblasting process is preferably 0.2 MPa to 0.4 MPa, more preferably 0.25 MPa to 0.35 MPa, even more preferably 0.27 MPa to 0.33 MPa;

the solvent used for ultrasonic cleaning is either ethanol or acetone, the frequency for ultrasonic cleaning is preferably 40 kHz to 80 kHz, more preferably 50 kHz to 70 kHz, even more preferably 55 kHz to 65 kHz; and the cleaning time is preferably 10 min to 60 min, more preferably 15 min to 40 min, even more preferably 20 min to 30 min;

the preferred drying equipment is a compressed air dryer, the drying temperature is preferably 40° C. to 80° C., more preferably 50° C. to 70° C., even more preferably 55° C. to 65° C.; and the drying time is preferably 2 h to 6 h, more preferably 3 h to 5 h, even more preferably 3.5 h to 4.5 h.

After the spraying process is completed, the composite coating and composite bulk material can be used directly or after undergoing annealing, the annealing temperature is preferably 435° C. to 600° C., more preferably 450° C. to 550° C., and even more preferably 480° C. to 500° C.; the selection of annealing time is based on the principle that the amorphous alloy does not undergo crystallization at a specific annealing temperature, preferably 5 min to 30 min, more preferably 10 min to 25 min, and even more preferably 15 min to 20 min.

Embodiment 3

Please refer to FIG. 1, an amorphous alloy reinforced Cu-based composite coating and composite bulk material and a preparation method thereof, comprising the following steps:

Step 1: blending the compositions of the composite coat in the following specified proportion, i.e., the mass fraction of Cu 95%, and the mass fraction of amorphous alloy ($Fe_{54.61}Mo_{16.8}Cr_{25.8}C_{2.44}Si_{0.35}$) is 5%;

Step 2: feeding the raw powder materials with a particle size of 35 μm into the V-type powder mixer, and mixing evenly at a speed of 250 r/min for 60 min;

Step 3: then drying the mixed powder at 60° C. for 4 h;

Step 4: performing sandblasting treatment on the Al alloy substrate, setting the inlet pressure for sandblasting treatment at 0.7 MPa, and the pressure for sandblasting process at 0.3 MPa;

Step 5: afterward, placing the substrate into an ethanol solvent and performing ultrasonic treatment at 60 kHz for 25 min, then drying at 60° C. for 4 h;

Step 6: feeding the dried powder into the powder feeding system of the cold spray system, using $N_2$ gas at a temperature of 600° C. and pressure of 4 MPa for spraying;

Step 7: setting the spray receiving device as the pretreated Al alloy substrate, controlling the spraying distance to be 22 mm and the walking speed to be 50 mm/s;

Step 8: finally, obtaining a composite coating material with a thickness of 800 μm.

TABLE 1

Performance test results of the Cu-based composite coating of embodiment 3

| Performance | Density (%) | Shear strength (MPa) | Micro-hardness (HV) | Wear rate ($10^{-5}$ $mm^3$/Nm) | Conductivity (MS/m) |
|---|---|---|---|---|---|
| Cu-based composite coating | 99.2 | 56.13 | 188.52 | 18.75 | 48.77 |

Embodiment 4

Please refer to FIG. 1, an amorphous alloy reinforced Cu-based composite coating and composite bulk material and a preparation method thereof, comprising the following steps:

Step 1: blending the compositions of the composite coat in the following specified proportion, i.e., the mass fraction of Cu 85%, and the mass fraction of amorphous alloy ($Fe_{54.61}Mo_{16.8}Cr_{25.8}C_{2.44}Si_{0.35}$) is 15%; a particle size of Cu is 30 μm, and a particle size of amorphous alloy ($Fe_{54.61}Mo_{16.8}Cr_{25.8}C_{2.44}Si_{0.35}$) is 33 μm;

Step 2: feeding the above raw powder materials into a three-dimensional powder mixer, and mixing evenly at a speed of 200 r/min for 70 min;

Step 3: then drying the mixed powder at 50° C. for 5 h;

Step 4: performing sandblasting treatment on the Al alloy substrate, setting the inlet pressure for sandblasting treatment at 0.75 MPa, and the pressure for sandblasting process at 0.32 MPa;

Step 5: afterward, placing the substrate into an acetone solvent and performing ultrasonic treatment at 65 kHz for 20 min, then drying at 55° C. for 4.5 h;

Step 6: feeding the dried powder into the powder feed system of the cold spray system, using $N_2$ gas at a temperature of 600° C. and pressure of 4.5 MPa for spraying;

Step 7: setting the spray receiving device as the pretreated Al alloy substrate, controlling the spraying distance to be 22 mm and the walking speed to be 50 mm/s;

Step 8: finally, obtaining a composite coating material with a thickness of 1000 μm.

TABLE 2

Performance test results of the Cu-based composite coating of embodiment 4

| Performance | Density (%) | Shear strength (MPa) | Micro-hardness (HV) | Wear rate ($10^{-5}$ $mm^3$/Nm) | Conductivity (MS/m) |
|---|---|---|---|---|---|
| Cu-based composite coating | 99.22 | 78.93 | 190.64 | 14.5 | 47.26 |

Embodiment 5

Please refer to FIG. 1, an amorphous alloy reinforced Cu-based composite coating and composite bulk material and a preparation method thereof, comprising the following steps:

Step 1: blending the compositions of the composite coat in the following specified proportion, i.e., the mass fraction of Cu 75%, and the mass fraction of amorphous alloy ($Fe_{54.61}Mo_{16.8}Cr_{25.8}C_{2.44}Si_{0.35}$) is 25%;

Step 2: feeding the above raw powder materials with a particle size of 35 μm into a three-dimensional powder mixer, and mixing evenly at a speed of 200 r/min for 55 min; then drying the mixed powder at 65° C. for 3 h;

Step 3: performing sandblasting treatment on the Al alloy substrate, setting the inlet pressure for sandblasting treatment at 0.67 MPa, and the pressure for sandblasting process at 0.29 MPa;

Step 4: afterward, placing the substrate into an ethanol solvent and performing ultrasonic treatment at 55 kHz for 30 min, then drying at 65° C. for 3.5 h;

Step 5: feeding the dried powder into the powder feed system of the cold spray system, using $N_2$ gas at a temperature of 600° C. and pressure of 5 MPa for spraying;

Step 6: setting the spray receiving device as the pretreated Al alloy substrate, controlling the spraying distance to be 20 mm and the walking speed to be 50 mm/s;

Step 7: finally, obtaining a composite coating material with a thickness of 1100 μm.

TABLE 3

| Performance test results of the Cu-based composite coating of embodiment 5 | | | | | |
|---|---|---|---|---|---|
| Performance | Density (%) | Shear strength (MPa) | Micro-hardness (HV) | Wear rate ($10^{-5}$ $mm^3/Nm$) | Conductivity (MS/m) |
| Cu-based composite coating | 99.7 | 52.59 | 185.43 | 13.4 | 44.18 |

Embodiment 6

Please refer to FIG. 1, an amorphous alloy reinforced Cu-based composite coating and composite bulk material and a preparation method thereof, comprising the following steps:

Step 1: blending the compositions of the composite coat in the following specified proportion, i.e., the mass fraction of Cu 65%, and the mass fraction of amorphous alloy ($Fe_{54.61}Mo_{16.8}Cr_{25.8}C_{2.44}Si_{0.35}$) is 35%; a particle size of Cu is 30 μm, and a particle size of amorphous alloy ($Fe_{54.61}Mo_{16.8}Cr_{25.8}C_{2.44}Si_{0.35}$) is 33 μm;

Step 2: feeding the above raw powder materials into a two-dimensional powder mixer, and mixing evenly at a speed of 200 r/min for 70 min; then drying the mixed powder at 50° C. for 5 h;

Step 3: performing sandblasting treatment on the Cu substrate, setting the inlet pressure for sandblasting treatment at 0.75 MPa, and the pressure for sandblasting process at 0.32 MPa;

Step 4: afterward, placing the Cu substrate into an acetone solvent and performing ultrasonic treatment at 65 kHz for 20 min, then drying at 55° C. for 4.5 h;

Step 5: feeding the dried powder into the powder feed system of the cold spray system, using Ar gas at a temperature of 600° C. and pressure of 4 MPa for spraying;

Step 6: setting the spray receiving device as the pretreated Cu substrate, controlling the spraying distance to be 22 mm and the walking speed to be 50 mm/s;

Step 7: finally, obtaining a composite coating material with a thickness of 600 μm.

TABLE 4

| Performance test results of the Cu-based composite coating of embodiment 6 | | | | | |
|---|---|---|---|---|---|
| Performance | Density (%) | Shear strength (MPa) | Micro-hardness (HV) | Wear rate ($10^{-5}$ $mm^3/Nm$) | Conductivity (MS/m) |
| Cu-based composite coating | 99.39 | 97.62 | 203.16 | 12.8 | 39.97 |

Embodiment 7

Please refer to FIG. 1, an amorphous alloy reinforced Cu-based composite coating and composite bulk material and a preparation method thereof, comprising the following steps:

Step 1: blending the compositions of the composite coat in the following specified proportion, i.e., the mass fraction of Cu 75%, and the mass fraction of amorphous alloy ($Fe_{54.61}Mo_{16.8}Cr_{25.8}C_{2.44}Si_{0.35}$) is 25%;

Step 2: feeding the above raw powder materials with a particle size of 35 μm into a three-dimensional powder mixer, and mixing evenly at a speed of 200 r/min for 55 min; then drying the mixed powder at 65° C. for 3 h;

Step 3: performing sandblasting treatment on the Al alloy substrate, setting the inlet pressure for sandblasting treatment at 0.67 MPa, and the pressure for sandblasting process at 0.29 MPa;

Step 4: afterward, placing the substrate into an ethanol solvent and performing ultrasonic treatment at 55 kHz for 30 min, then drying at 65° C. for 3.5 h;

Step 5: feeding the dried powder into the powder feed system of the cold spray system, using $N_2$ gas at a temperature of 600° C. and pressure of 4 MPa for spraying;

Step 6: setting the spray receiving device as the pretreated Al alloy substrate, controlling the spraying distance to be 20 mm and the walking speed to be 50 mm/s;

Step 7: finally, obtaining a composite coating material with a thickness of 1 cm.

TABLE 5

| Performance test results of the Cu-based composite coating of embodiment 7 | | | | | |
|---|---|---|---|---|---|
| Performance | Density (%) | Shear strength (MPa) | Micro-hardness (HV) | Wear rate ($10^{-5}$ $mm^3/Nm$) | Conductivity (MS/m) |
| Cu-based composite coating | 99.57 | 48.16 | 185.43 | 13 | 43.37 |

Embodiment 8

Please refer to FIG. 1, an amorphous alloy reinforced Cu-based composite coating and composite bulk material and a preparation method thereof, comprising the following steps:

Step 1: blending the compositions of the composite coat in the following specified proportion, i.e., the mass fraction of Cu 75%, and the mass fraction of amorphous alloy ($Fe_{54.61}Mo_{16.8}Cr_{25.8}C_{2.44}Si_{0.35}$) is 25%;

Step 2: feeding the above raw powder materials with a particle size of 35 μm into a three-dimensional powder mixer, and mixing evenly at a speed of 200 r/min for 55 min; then drying the mixed powder at 65° C. for 3 h;

Step 3: performing sandblasting treatment on the Al alloy substrate, setting the inlet pressure for sandblasting treatment at 0.67 MPa, and the pressure for sandblasting process at 0.29 MPa;

Step 4: afterward, placing the substrate into an ethanol solvent and performing ultrasonic treatment at 55 kHz for 30 min, then drying at 65° C. for 3.5 h;

Step 5: feeding the dried powder into the powder feed system of the cold spray system, using $N_2$ gas at a temperature of 600° C. and pressure of 4 MPa for spraying;

Step 6: setting the spray receiving device as the pretreated Al alloy substrate, controlling the spraying distance to be 20 mm and the walking speed to be 50 mm/s;

Step 7: finally, obtaining a composite coating material with a thickness of 1 cm.

In step 7, the obtained composite bulk material was annealed at 500° C. for 15 min, and the performance of the composite bulk material was tested. The results are shown in Table 6.

TABLE 6

Performance test results of the Cu-based composite coating of embodiment 8

| Performance | Density (%) | Shear strength (MPa) | Micro-hardness (HV) | Wear rate ($10^{-5}$ $mm^3$/Nm) | Conductivity (MS/m) |
|---|---|---|---|---|---|
| Cu-based composite coating | 99.57 | 184.39 | 93.58 | 13.3 | 48.7 |

Although the embodiments of the invention have been shown and described above, it should be understood that those skilled in the art can make changes, modifications, substitutions and alterations to the above embodiments without departing from the principles and spirit of the invention. The scope of the invention is defined by the claims and their equivalents.

The invention claimed is:

1. An amorphous alloy reinforced Cu-based composite coating and composite bulk material, comprising an amorphous alloy reinforced Cu-based composite coating and an amorphous alloy reinforced Cu-based composite bulk material, wherein both the amorphous alloy reinforced Cu-based composite coating and the amorphous alloy reinforced Cu-based composite bulk material comprise at least Cu powder and amorphous alloy ($Fe_{54.61}Mo_{16.8}Cr_{25.8}C_{2.44}Si_{0.35}$) powder.

2. The amorphous alloy reinforced Cu-based composite coating and composite bulk material of claim 1, wherein a proportion of the Cu powder included in the amorphous alloy reinforced Cu-based composite coating and the amorphous alloy reinforced Cu-based composite bulk material is 55% to 95%.

3. The amorphous alloy reinforced Cu-based composite coating and composite bulk material of claim 1, wherein a proportion of the amorphous alloy ($Fe_{54.61}$Mo16.8$Cr_{25.8}C_{2.44}Si_{0.35}$) powder content in the amorphous alloy reinforced Cu- based composite coating and the amorphous alloy reinforced Cu-based composite bulk material is 5% to 45%.

4. The amorphous alloy reinforced Cu-based composite coating and composite bulk material of claim 1, wherein the particle sizes of both the Cu powder and the amorphous alloy ($Fe_{54.61}Mo_{16.8}Cr_{25.8}C_{2.44}Si_{0.35}$) powder included in the amorphous alloy reinforced Cu-based composite coating and the amorphous alloy reinforced Cu-based composite bulk material range from 20 μm to 50 μm.

5. A preparation method of the amorphous alloy reinforced Cu-based composite coating and composite bulk material of claim 1, comprising the following steps:

S1: firstly, sieving the Cu powder particles and the amorphous alloy ($Fe_{54.61}Mo_{16.8}Cr_{25.8}C_{2.44}Si_{0.35}$) powder particles to a specified particle size;

S2: secondly, according to a specified proportion for the composite coating, blending the Cu powder and the amorphous alloy ($Fe_{54.61}Mo_{16.8}Cr_{25.8}C_{2.44}Si_{0.35}$) powder in the above specified proportion;

S3: then, pouring the blended Cu powder and the amorphous alloy ($Fe_{54.61}Mo_{16.8}Cr_{25.8}C_{2.44}Si_{0.35}$) powder into a powder mixer; S4: once the Cu powder and the amorphous alloy ($Fe_{54.61}Mo_{16.8}Cr_{25.8}C_{2.44}Si_{0.35}$) powder are fully mixed, drying mixed powder;

S5: finally, obtaining the processed amorphous alloy reinforced Cu-based composite coating and composite bulk material.

6. The preparation method of the amorphous alloy reinforced Cu-based composite coating and composite bulk material of claim 5, wherein in S3, the powder mixer used is a V-type powder mixer, and the powder mixer used can also be a three-dimensional powder mixer or a two-dimensional powder mixer, and the mixing speed of the powder mixer is 150 r/min to 300 r/min, and the mixing time of the powder mixer is 30 min to 90 min.

7. The preparation method of the amorphous alloy reinforced Cu-based composite coating and composite bulk material of claim 5, wherein in S4, the drying time for the mixed Cu powder and the amorphous alloy ($Fe_{54.61}Mo_{16.8}Cr_{25.8}C_{2.44}Si_{0.35}$) powder is 2 h to 6 h, and drying temperature is 40° C. to 80° C.

8. The preparation method of the amorphous alloy reinforced Cu-based composite coating and composite bulk material of claim 5, wherein in S4, the Cu powder and the amorphous alloy powder are treated to obtain the mixed powder, and the mixed powder is fed into a powder feed system of a cold spray system for spraying.

9. The preparation method of the amorphous alloy reinforced Cu-based composite coating and composite bulk material of claim 8, wherein the powder feed system comprises at least a receiving device, the receiving device is made of Al alloy substrate, the spraying distance for the spraying process is 20 mm to 40 mm;

the gas used in the spraying process of the cold spray system is at least one of N2, Ar, or He, the gas temperature for the spraying is 500° C. to 800° C., and the gas pressure for the spraying is 3 MPa to 6 MPa.

10. The preparation method of the amorphous alloy reinforced Cu-based composite coating and composite bulk material of claim 9, wherein the receiving device needs to be pretreated before use, the pretreatment at least includes sandblasting, ultrasonic cleaning, and drying treatments;

the inlet pressure for the sandblasting treatment is 0.6 MPa to 0.8 MPa;

the solvent used for ultrasonic cleaning is either ethanol or acetone, the frequency for ultrasonic cleaning is 40 kHz to 80 kHz, and the cleaning time is 10 min to 60 min;

the drying equipment is a compressed air dryer, the drying temperature is 40° C. to 80° C., and the drying time is 2 h to 6 h.

* * * * *